United States Patent [19]

Guillaume

[11] 4,438,941

[45] Mar. 27, 1984

[54] SUPPORT FOR CHILD

[75] Inventor: Raymond Guillaume, Mougins, France

[73] Assignee: Baby Relax, Anglet, France

[21] Appl. No.: 274,628

[22] Filed: Jun. 17, 1981

[30] Foreign Application Priority Data

Jun. 18, 1980 [FR] France ..... 80 13481

[51] Int. Cl.[3] ..... B62B 7/00

[52] U.S. Cl. ..... 280/47.4; 297/82; 5/93 R

[58] Field of Search ..... 297/81, 82, 118; 5/431, 5/432, 433, 437, 93, 98; 280/47.38, 47.4, 47.41, 648

[56] References Cited

U.S. PATENT DOCUMENTS

| | | | |
|---|---|---|---|
| 525,051 | 8/1894 | Knight et al. | 297/81 X |
| 661,344 | 11/1900 | Jones | 280/47.4 |
| 2,277,583 | 3/1942 | Feldman | 280/648 |
| 2,661,048 | 12/1953 | Lorenz | 297/82 X |
| 2,872,203 | 2/1959 | Hedstrom | 280/47.4 |
| 3,094,339 | 6/1963 | Hurvitz | 5/93 R X |
| 3,330,575 | 7/1967 | Boudreau | 280/648 |
| 3,871,701 | 3/1975 | Gesslein | 5/93 R X |
| 4,391,453 | 7/1983 | Glaser | 280/47.4 |

*Primary Examiner*—Francis K. Zugel

*Attorney, Agent, or Firm*—Brumbaugh, Graves, Donohue & Raymond

[57] ABSTRACT

The invention relates to a support for child having an articulated framework, a bottom supported by this framework and a body element forming at least partial connection between the bottom and the framework. The framework has parallel longitudinal elements and hoop elements articulated on the longitudinal elements and forms a deformable parallelogram. One of the hoop elements, located at the foot end of the framework, is provided with an element which is fast therewith to constitute foot rest, while the body element comprises a rigid bottom made of two parts articulated transversely to each other. The bottom part closer to the foot rest is free with respect to the body element and supported by a crosspiece coupled to the framework in the form of a stirrup; the other bottom part is rendered fastened to the body element.

9 Claims, 5 Drawing Figures

SUPPORT FOR CHILD

BACKGROUND OF THE INVENTION

The present invention relates to a support for child.

Numerous seats for children are known which can be transformed from a first position, in which they constitute a real seat, and a second position, in which they are similar to a bed the child is able to lie down in the support. In addition, all intermediate positions are possible between these two extreme positions.

However, at the present time, no support exists which can be transformed from its seat form to the form of a perambulator body, i.e. in which the bottom is completely flat and is surrounded by four vertical walls.

SUMMARY OF THE INVENTION

The present invention relates to such a support and to means for adapting it in particular to a pushchair or stroller chassis having an articulated framework, a bottom supported by this framework and a body element forming an at least partial connection between the bottom and the framework. The framework includes two first parallel longitudinal elements, two end hoop elements articulated on the first longitudinal elements, and two second parallel longitudinal elements, parallel to the first longitudinal elements and articulated on the hoop elements so that, seen in profile, the hoop element-longitudinal element assembly constitute a parallelogram deformable from a first position in which the longitudinal elements and hoop elements substantially form a frame contained in a plane to a second position in which said hoop elements form with the longitudinal elements three consecutive planes defining the general appearance of a seat.

According to one of the features of the invention, the hoop element located at the foot end of the framework is provided with an element which is fastened thereto and substantially perpendicular to the plane of the frame so that, in the second position, this element is substantially parallel to the longitudinal elements to constitute a foot rest. The body element forms a substantially parallelepipedic pouch coupled to the transverse parts of the hoop elements and to the foot rest. A rigid bottom includes two parts articulated transversely with respect to each other. The bottom part closer to the foot rest is free with respect to the body element and supported by a crosspiece coupled to the framework in the form of a stirrup. The other bottom part is rendered fast with the pouch.

In a first variant, the stirrup-shaped crosspiece is fast with the foot hoop element of the framework.

In a second variant, the stirrup-shaped crosspiece is fast with the first two longitudinal elements mentioned above.

In addition, the two second longitudinal elements may be connected by a second crosspiece also in the form of a stirrup. This crosspiece forms a support for the bottom of the pouch in perambulator position or a ground rest when the pouch is in seat position.

BRIEF DESCRIPTION OF THE DRAWINGS

The invention will be more readily understood on reading the following description with reference to the accompanying drawings, in which.

DETAILED DESCRIPTION OF THE PREFERRED EMBODIMENTS

Figure 1:
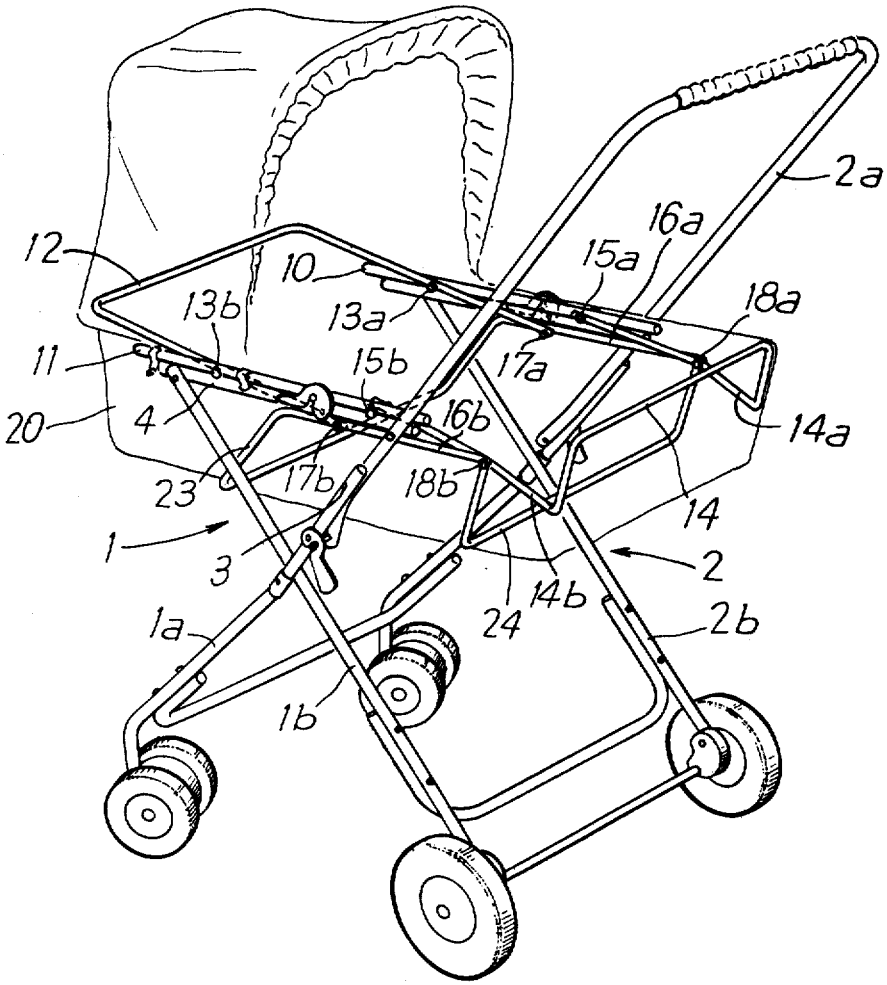
FIG. 1 is a schematic view of the support according to the invention mounted on the chassis of a child's pushchair.

Referring now to the drawings, FIG. 1 shows a pushchair chassis, known per se, having two lateral cross braces 1 and 2 each comprising an upright portion 1*a*, 2*a*, foldable on itself about a pivot pin 3, and another portion 1*b*, 2*b*. This chassis is provided with one bar 4 per cross brace which includes the elements for supporting the support according to the invention on the pushchair chassis.

Figure 2:
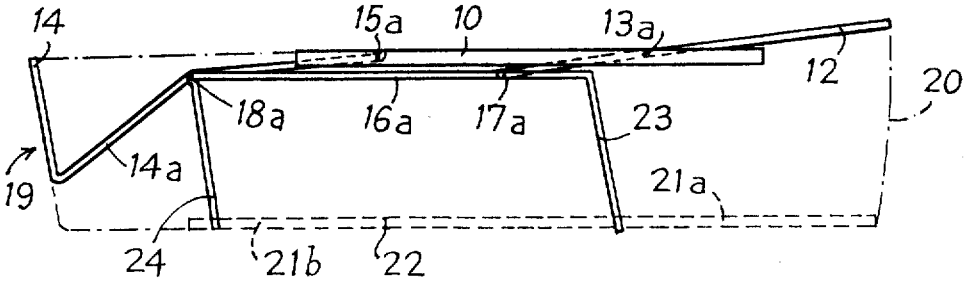
FIGS. 2 and 3 show schematic side views of two extreme positions of a first embodiment of the invention.
Figure 3:
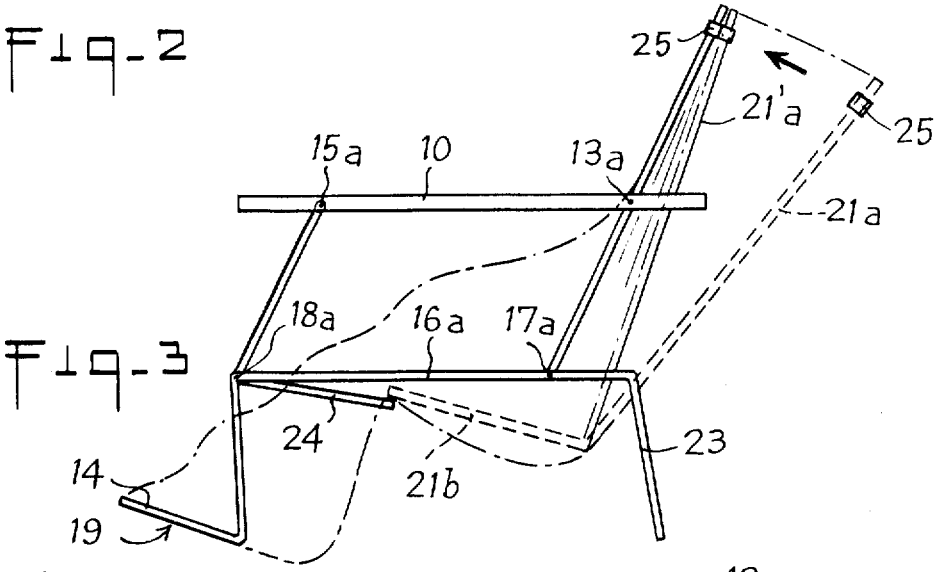

This support, as shown in a first variant in FIGS. 1, 2 and 3, comprises two first longitudinal elements 10 and 11 which may be fixed by any suitable means (in particular by helically wound hooks) on the bars 4. On the longitudinal elements 10 and 11 are articulated, on the one hand, a first or head hoop element 12 about articulations 13*a*, 13*b* and a second or foot hoop element 14 about articulations 15*a*, 15*b*.

A pair of second longitudinal elements 16*a*, 16*b* is also articulated by pivot points 17*a*, 17*b* and 18*a*, 18*b* on the hoop elements 12 and 14 respectively. Seen from the side (as in FIGS. 2 and 3), the framework according to the invention is in the form of a parallelogram articulated at 13*a*, 15*a*, 17*a*, 18*a*. In its first position—FIGS. 1 and 2—this framework defines a substantially flat frame, the hoop elements, or at least the transverse parts thereof, as well as the four longitudinal elements being located substantially at the same level.

It will be noted in these two figures that the loop element 14 is of such a shape that the side arm 14*a* and 14*b* thereof define with the transverse part of the hoop element a substantially flat return that is virtually perpendicular to the plane of the frame. This return, designated by reference numeral 19 in FIG. 2, defines the foot wall of the support in its perambulator form and a footrest in its seat form (FIG. 3).

A body element 20, constituted by a pouch made of fabric or other supple material, is placed in position on the framework and, in particular, fixed on the transverse parts of the hoop elements 12 and 14, and the body element 20 defines an upwardly open, substantially parallelepipedic body with the rigid bottom.

This bottom includes two parts, 21*a* and 21*b*. The part 21*a* is fastened the pouch 20, whilst the part 21*b* is not connected to the pouch, but the part 21*b* is articulated on the part 21*a* along a transverse line 22.

It should further be noted that, to support the fabric of the body element 20, the longitudinal elements 16*a* and 16*b* have been extended by a stirrup-shaped crosspiece 23, of which the transverse part is sufficiently remote from the plane of the longitudinal elements 16*a*, 16*b* to allow the body to be positioned. It is seen that this crosspiece serves as a support for the bottom part 21*a*. Similarly, a stirrup-shaped crosspiece 24 is provided at the front of the framework to support the bottom part 21*b*. This crosspiece 24 is fastened to the hoop element 14 and is substantially parallel to the flat return 19, which forms the footrest. Due to this connection between the crosspiece 24 and the hoop element 14, when the perambulator body of FIG. 2 is transformed into the seat of FIG. 3, it is seen that the crosspiece 24 pivots with respect to the longitudinal elements 16*a* and 16*b*. Since the crosspiece 24 is a point of support for the bottom part 21*b*, the bottom part 21*b* pivots with respect to the bottom part 21*a* along the line 22 and constitute the seat which is articulated on the bottom part, 21*a* which is now a backrest, of the support in its position of FIG. 3.

The transformation from perambulator (FIG. 2) to seat (FIG. 3) is obtained by righting the bottom part 21*a* and deforming the front part of the body 19, 21*b* by pivoting the hoop element 14, with its particular conformation and association with the stirrup-shaped crosspiece 24.

Further modification may be made to the seat, which, as shown, presents upper and side panels, surrounding the back rest for protection of the seat, by bringing the bottom 21*a* closer to the extreme part of the hoop element 12 and maintaining it hooked thereon by means of fastening members 25 (as shown at 21'*a*). Finally, to ensure that the framework is immobilized in any position, blocking means may be provided (not shown, but known per se) for locking one or two of the articulations 18*a,b*, 17*a,b*, 15*a,b*, 13*a,b*.

Figure 4:
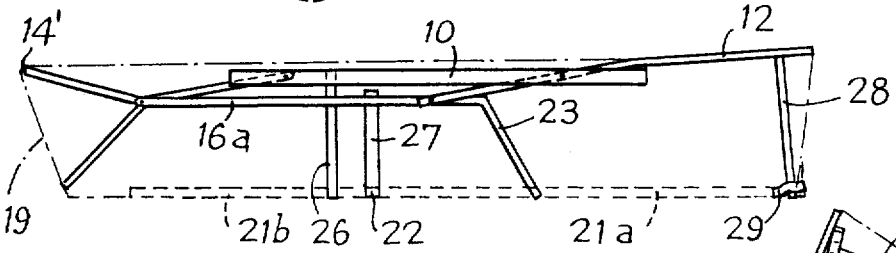
FIGS. 4 and 5 show, in similar views, a second embodiment of the invention.
Figure 5:
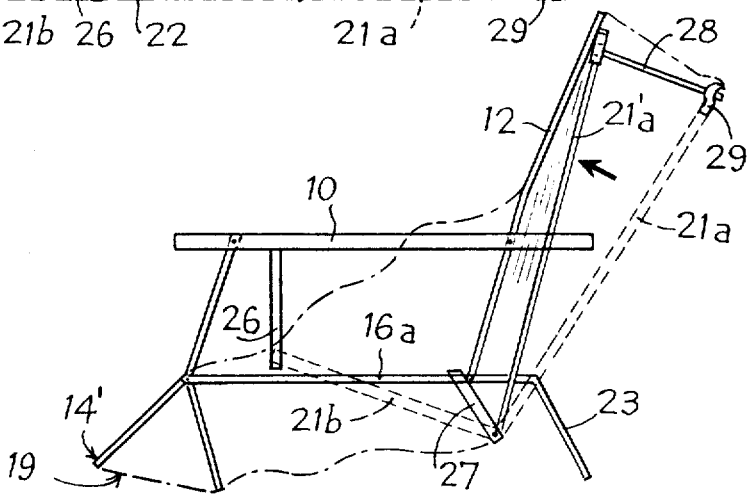

FIGS. 4 and 5 show a variant embodiment of the support according to the invention, in which the elements which have already been described are given the same references. It will be noted that a hoop element 14', of a different shape than the hoop element 14 in FIGS. 1-3, is not provided with the stirrup-shaped crosspiece 24. The bottom 21*b* is supported by the fabric of the pouch and by a stirrup shaped crosspiece 26, which is fastened to the longitudinal elements 10 and 11. In addition, the articulation of the two parts 21*a* and 21*b* is supported by a supple strap 27 mounted to slide on the longitudinal elements 16*a*, 16*b*. Thus, when the support of FIG. 4 is changed to that of FIG. 5, the stirrup 26 remains at the same level and remains a fixed support for the part 21*b*, which slides on the stirrup to the position shown in FIG. 5. A member (not shown) of the longitudinal slot type may be provided beneath the part 21*b* in which the stirrup 26 is imprisoned in order to prevent the part 21*b* from escaping from the stirrup 26 at the end of the folding operation.

It will also be noted that the hoop element 12 is provided with a stirrup 28, which is substantially perpendicular thereto and which supports the rear end of the part 21*a*. The stirrup 28 also constitutes a member for holding the bottom part 21*a* in the position shown in FIG. 5 by means of lateral loops 29, which are fastened to the bottom and adapted to slide along the arms of the stirrup 28. These loops guide the bottom when it is brought closer (at 21'*a*) in FIG. 5 to the hoop element 12.

FIGS. 3 and 5 illustrate a detail of the invention according to which the stirrup 23, which connects the longitudinal members 16*a*, 16*b*, constitutes an element for supporting the seat, the other element being constituted by the foot rest.

These figures also show one of the longitudinal edges of the pouch 20. This is seen to be pleated. In order to give it a certain stability when the support is in seat position, it is advantageous to provide these longitudinal edges with elastic or to make them from elastic so that they pucker whilst maintaining a certain stiffness. In perambulator position, the stretched elastic edges add to the finish of the body.

The mechanism of the invention is seen to be extremely simple. The invention satisfies the need for a baby carriage from birth when the infant can lie in a perambulator with a rigid flat bottom up to the moment when the child can dispense with a carriage, altogether. Consequently, the invention is economically very advantageous. In addition to the basic structure constituted by the seat-perambulator framework, any useful accessories may be added such as a hood (outlined in FIG. 1), which is suitable both for the perambulator and for the pushchair conformation, as apron, a converlet, etc . . .

The invention is advantageously applicable in the field of child welfare.

The invention is not limited to the description which has just been given but, on the contrary, covers all variants which may be made thereto without departing from the scope of the invention.

What is claimed is:

1. A support means transformable into a seat or perambulator, comprising an articulated framework, a bottom supported by the framework and a body element forming at least a partial connection between the bottom and the framework, wherein the framework has a head end and a foot end and includes two first parallel longitudinal elements, two end hoop elements articulated on said first longitudinal elements, and two second parallel longitudinal elements parallel to said first longitudinal elements and articulated on said hoop elements so that, seen in profile, the hoop element-longitudinal element assembly constitutes a parallelogram deformable from a first position in which the longitudinal elements and hoop elements substantially form a frame contained in a plane to a second position in which said hoop elements form with the longitudinal elements three consecutive planes defining the general appearance of a seat, wherein the end hoop element located at the foot end of the framework includes means for defining a footrest, said footrest means being substantially perpendicular to the plane of said frame in the first position and being substantially parallel to said longitudinal elements in the second position, wherein the body element forms a substantially parallelepipedic pouch coupled at least to the transverse parts of said hoop elements and to the footrest means, and wherein the bottom includes two parts articulated transversely to each other, the bottom part nearer said footrest means being free with respect to the body element and supported by a first stirrup-shaped crosspiece coupled to said framework and the other bottom part being fastened to said pouch.

2. The support means according to claim 1, wherein the first stirrup-shaped crosspiece is fastened to the end hoop element located at the foot end of the framework.

3. The support means according to claim 1, wherein the first stirrup-shaped crosspiece is fastened to the two first longitudinal elements.

4. The support means according to any one of claims 1 to 3, wherein said second longitudinal elements are connected by a second stirrup-shaped crosspiece, said second stirrup-shaped crosspiece forming a support for the bottom part fastened to said pouch in the first position.

5. The support means according to any one of claims 1 to 3, wherein the end hoop element located at the head end of the framework is provided with a lower return part in the form of a stirrup for supporting the head end of the pouch.

6. The support means according to any one of claims 1 to 3, wherein the bottom part fastened to the pouch includes means for connecting it to the end hoop element located at head end of the framework in the vicinity of the transverse part thereof.

7. The support means according to claim 6, wherein the end hoop element located at the head end of the framework is provided with a lower return part in the form of a stirrup for supporting the head end of the pouch, said lower return part of the head hoop element including a member for laterally and longitudinally holding the bottom of the pouch and for guiding the latter for connection thereof to the head hoop element.

8. The support means according to any one of claims 1 to 3, wherein the longitudinal edges of the pouch are elastic.

9. The support means according to any one of claims 1 to 3, wherein at least one of the articulations of the framework is provided with a means for immobilizing it.

* * * * *